US009068331B2

(12) United States Patent
Blom

(10) Patent No.: US 9,068,331 B2
(45) Date of Patent: Jun. 30, 2015

(54) TOILET OVERFLOW PREVENTION DEVICE

(71) Applicant: Adam Joshua Blom, Oro Valley, AZ (US)

(72) Inventor: Adam Joshua Blom, Oro Valley, AZ (US)

( * ) Notice: Subject to any disclaimer, the term of this patent is extended or adjusted under 35 U.S.C. 154(b) by 204 days.

(21) Appl. No.: 13/914,714

(22) Filed: Jun. 11, 2013

(65) Prior Publication Data

US 2014/0201896 A1 Jul. 24, 2014

Related U.S. Application Data

(60) Provisional application No. 61/755,526, filed on Jan. 23, 2013.

(51) Int. Cl.
*E03D 11/02* (2006.01)
*E03D 5/02* (2006.01)

(52) U.S. Cl.
CPC ..... *E03D 5/026* (2013.01); *E03D 11/02* (2013.01)

(58) Field of Classification Search
CPC ..... E03D 11/16; E03D 11/00
USPC ..... 4/300–442
See application file for complete search history.

(56) References Cited

U.S. PATENT DOCUMENTS

| | | | | |
|---|---|---|---|---|
| 6,032,303 | A | 3/2000 | Schmidt | |
| 7,356,856 | B2 | 4/2008 | Butsch | |
| 7,383,594 | B1 | 6/2008 | Giesken | |
| 7,636,959 | B2 * | 12/2009 | Bowcutt et al. | 4/427 |
| 2008/0177994 | A1 * | 7/2008 | Mayer | 713/2 |

* cited by examiner

*Primary Examiner* — Lori Baker
(74) *Attorney, Agent, or Firm* — Steven Fisher-Stawinski; Robert W. Gray; The Gray Law Group, Ltd

(57) ABSTRACT

The invention is directed to a toilet overflow prevention device. The device is a toilet tank shutoff system, composed of a sensor for use in the toilet bowl or tank, an electro-mechanical actuator, and an electronic communication link. The electromechanical actuator is configured to raise the control rod, which controls the filler valve of the toilet. A latch mechanism would retain the control rod, once it is raised. The system would raise the control rod upon receiving a signal from the sensor that the toilet is at risk of overflowing; the control rod would be retained in the raised position by the latch mechanism without requiring electric current, until released manually by the user. The sensor in the toilet bowl would preferably be in electronic communication with the electro-mechanical actuator in the toilet tank by a wire covered in a durable material, or by a short range, wireless communication protocol.

19 Claims, 2 Drawing Sheets

TOILET OVERFLOW PREVENTION DEVICE

CROSS-REFERENCE TO RELATED APPLICATIONS

This application claims priority to U.S. Provisional Application No. 61/755,526 filed on 23 Jan., 2013.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to toilet accessory devices, and in particular to a toilet overflow prevention device. When a mechanical failure occurs in the toilet tank, the damage caused can be substantial. Often times, the tank continues to fill the toilet bowl with water, causing the toilet bowl to overflow, spilling water on the floor that may be contaminated with human urine and fecal material. When this occurs, it not only requires clean-up, but may present a serious health hazard, damage the floor, or even create a liability issue if the owner resides in an upstairs apartment. An overflow prevention device that detects an elevated level of water in the toilet bowl, and shuts off the flow of water from the toilet tank before the toilet bowl overflows, would prevent the need for clean-up and also eliminate the health, water damage, and liability risks.

SUMMARY OF THE INVENTION

Accordingly, the invention is directed to a toilet overflow prevention device. The device is a toilet tank shutoff system, composed of a sensor for use in the toilet bowl or toilet tank, an electro-mechanical actuator, and an electronic communication link. The electro-mechanical actuator, such as a solenoid switch, is configured to raise the control rod, which controls the filler valve of the toilet. A latch mechanism would retain the control rod, once it is raised. The system would raise the control rod upon receiving a signal from the sensor that the toilet is at risk of overflowing; the control rod would be retained in the raised position by the latch mechanism without requiring electric current, until released manually by the user when the toilet is safe for use. The sensor in the toilet bowl would preferably be in electronic communication with the electro-mechanical actuator in the toilet tank by a wire covered in a durable material such as rubber or plastic, or by a short range, wireless communication protocol, such as Bluetooth.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
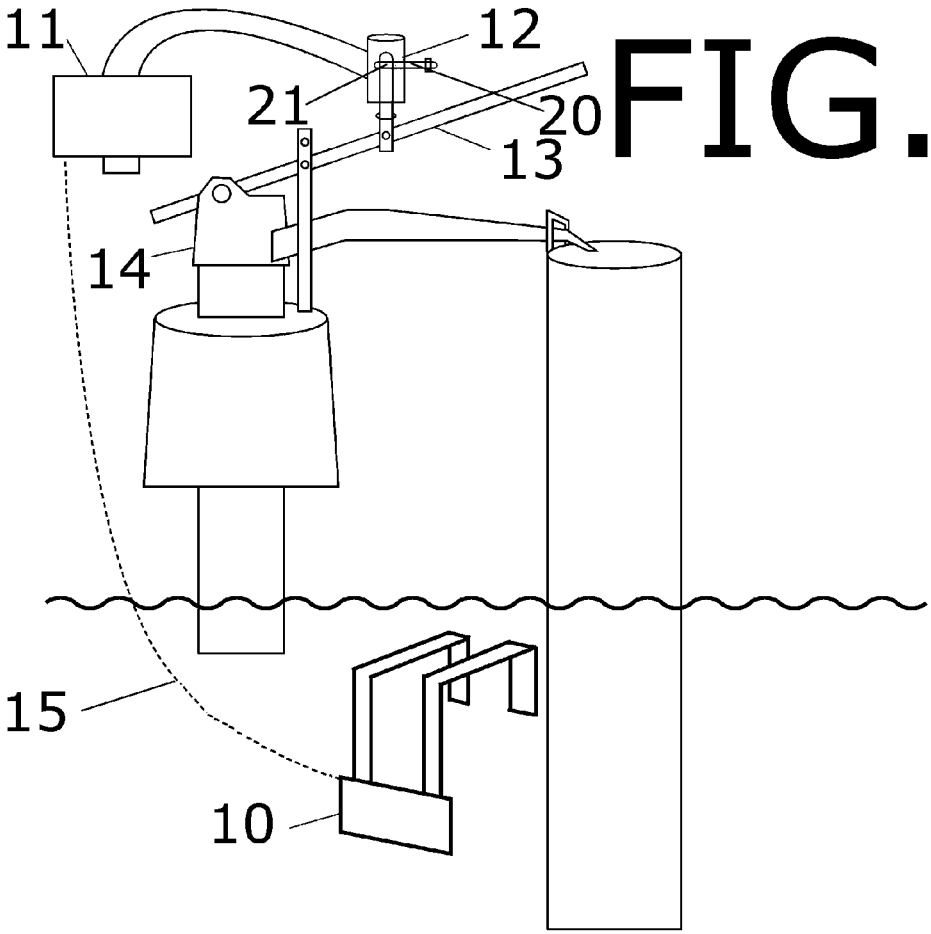
FIG. 1 shows a cutaway view of the first exemplary embodiment, displaying the sensor 10, the actuator 11, the first exemplary embodiment of the latch mechanism 12, the control rod 13, the filler valve 14, and the electronic communication link 15, as well as the latch mechanism spring-loaded pin 20 and solenoid rod hole 21.
Figure 2:
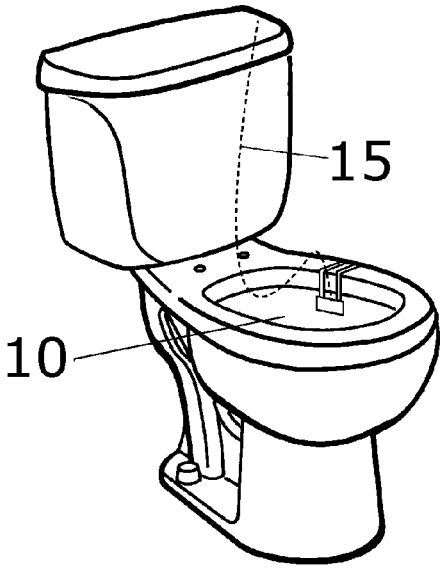
FIG. 2 shows the angular view of a toilet with the first exemplary embodiment installed, displaying the sensor 10, and the electronic communication link 15.
Figure 3:
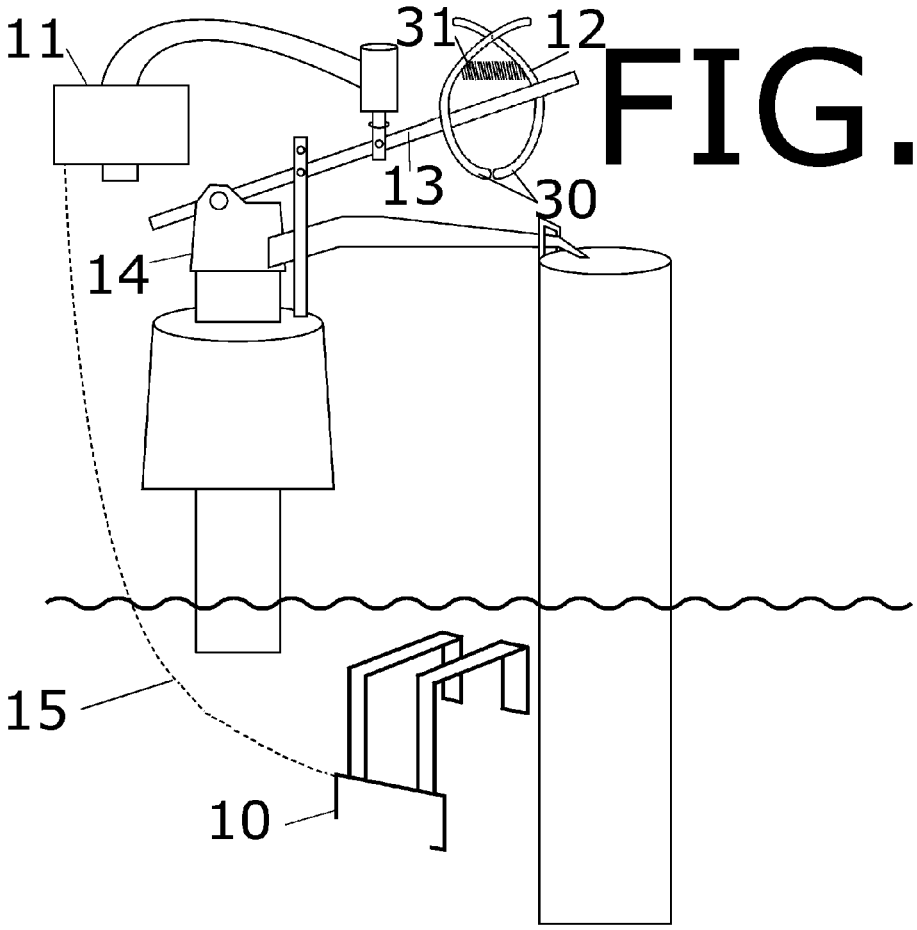
FIG. 3 shows a cutaway view of the second exemplary embodiment, displaying the sensor 10, the actuator 11, the second exemplary embodiment of the latch mechanism 12, the control rod 13, the filler valve 14, and the electronic communication link 15, as well as the latch mechanism arms 30 and spring 31.
Figure 4:
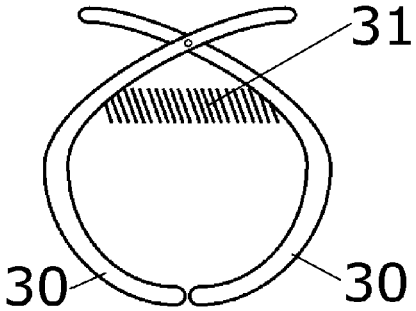
FIG. 4 shows a front view of the second exemplary embodiment of the latch mechanism, displaying the arms 30 and spring 31.

Referring now to the invention in more detail, the invention is directed a toilet overflow prevention device. The device is a toilet tank shutoff system, composed of a sensor 10 for use in the toilet bowl or toilet tank, an electro-mechanical actuator 11, and an electronic communication link 15. The electro-mechanical actuator 11, such as a solenoid switch, is configured to raise the control rod 13, which controls the filler valve 14 of the toilet. A latch mechanism 12 would retain the control rod 13, once it is raised. The system would raise the control rod 13 upon receiving a signal from the sensor 10 via the electronic communication link 15, that the toilet is at risk of overflowing; the control rod 13 would be retained in the raised position by the latch mechanism 12 without requiring electric current, until released manually by the user when the toilet is safe for use.

The latch mechanism 12 may take any of several forms. In one embodiment, a spring-loaded pin may engage with the solenoid rod as the rod is pulled up through the coil. The pin may then be made directly accessible to the outside of the solenoid housing for manual disengagement, or may be indirectly accessible for disengagement, for example via a mechanical button. The latch mechanism may alternatively provide a pair of spring-tensioned arms which are urged together but may be forced apart by the rising fill valve control rod and then allowed to close behind the control rod until manually released.

Any type of sensor 10 or heuristic may be used to determine when to activate the shutoff. In the first exemplary embodiment, the water level in the bowl may be monitored, and the system activated when the water level in the bowl exceeds a threshold, such as imminent overflow. To that end, the sensor 10 of the first exemplary embodiment is equipped with a plurality of hooks by which the sensor 10 may be suspended from the bowl edge. In a second exemplary embodiment, the sensor 10 may be mounted in the toilet tank to detect the control rod 13 being in the open position, and would monitor the time that the filler valve 14 is open or that the tank water level is low; if a time threshold is exceeded, the system is activated. An additional advantage of this embodiment is that it would detect and stop water from being wasted if the toilet is running, for example, due to the flapper being stuck open. In either embodiment or in embodiments utilizing different types of sensors and heuristics, the sensor 10 may include a microprocessor, computer memory, and power source, with appropriate software residing in a persistent region of the memory for execution by the microprocessor; the logic of the heuristic used may alternatively be embodied directly in digital or analog logic circuits. Because of the variable location of the sensor 10, the location of the sensor in FIG. 1 should not be understood as a literal location of the sensor 10 relative to the other components, but merely is a convenient position to illustrate the separate parts of the system functioning together.

Regardless of where the sensor 10 is placed, it is in electronic communication, via an electronic communication link 15 with the actuator 11. In the first exemplary embodiment, the sensor 10 would preferably be attached to the rim of the toilet tank, in a location that is higher than the normal expected water level. The communication between the sensor 10 and the actuator 11 is preferably achieved by running a wire between the sensor 10 and the actuator 11, or by using a short range wireless communication protocol, such as Bluetooth. If a wire is used as the electronic communication link 15, to facilitate the electronic communication between the sensor 10 and the actuator 11, the wire would preferably be covered in durable material such as rubber or plastic, in a coordinating color to the toilet, to minimize visibility of the device components. The covering of the wire would preferably prevent damage to the wire, enabling uninterrupted use of the device. The wire would preferably be composed of insulated copper. If the electronic communication link 15 is a short range wireless communication protocol, such as Bluetooth, the sensor 10 would preferably contain a radio wave transmitter and the actuator 11 would preferably contain a radio wave transmitter. Both the radio wave transmitter and receiver would preferably be battery powered and adhere to the standard protocol of the frequency-hopping spread spectrum.

In the second exemplary embodiment of the device, the sensor 10 is preferably placed in the toilet tank. The sensor 10 would preferably be attached to the filler valve 14. In this embodiment of the device, the sensor 10 would preferably detect the motion of the water as it runs and shut off the filler valve 14 as previously described in the first exemplary embodiment, after a pre-determined amount of time. The sensor 10 would preferably communicate with the actuator 11 via an electronic communication link 15, as previously described in the first exemplary embodiment of the device.

The device would preferably also include a provision for a reserve volume in the toilet bowl. This would stop the water from rising in the toilet bowl a significant distance from the rim, to permit the use of a plunger or other tool to clear any stoppage without causing an overflow.

Components listed are preferable, however, artisans will recognize that alternative components could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A toilet overflow prevention device comprising:

(a) an electromechanical actuation device;

(b) said electromechanical actuation device being movable in the vertical dimension in response to an electronic signal;

(c) said actuation device being rotatably fixed to a control rod associated with the fill valve of a conventional toilet filling system such that said control rod may be lifted up from a first normal operating position to a second inoperable position by the action of said actuation device;

(d) a sensor;

(e) an electronic link from said sensor to said electromechanical actuation device;

(f) a logic means for converting reading signals generated by said sensor into control signals directed to said electromechanical actuation device according to a heuristic;

(g) a latch mechanism;

(h) said latch mechanism being shaped and tensioned so as to receive said control rod in said second inoperable position and retain said control rod in said second inoperable position until manually released;

(i) said electromechanical activation device being a solenoid;

(j) said latch mechanism comprising a spring-loaded pin positioned horizontally so as to engage with a hole in the rod of said solenoid when said solenoid is in a raised position; and (k) said spring-loaded pin being further positioned so as to be manually disengageable;

whereby an imminent overflow in said toilet may be detected and averted by retaining the control rod in said second inoperable position and thereby forcing said fill valve into an off position regardless of water level.

2. A toilet overflow prevention device comprising:

(a) an electromechanical actuation device;

(b) said electromechanical actuation device being movable in the vertical dimension in response to an electronic signal;

(c) said actuation device being rotatably fixed to a control rod associated with the fill valve of a conventional toilet filling system such that said control rod may be lifted up from a first normal operating position to a second inoperable position by the action of said actuation device;

(d) a sensor;

(e) an electronic link from said sensor to said electromechanical actuation device;

(f) a logic means for converting reading signals generated by said sensor into control signals directed to said electromechanical actuation device according to a heuristic;

(g) a latch mechanism;

(h) said latch mechanism being shaped and tensioned so as to receive said control rod in said second inoperable position and retain said control rod in said second inoperable position until manually released;

(i) said latch mechanism comprising a pair of spring-loaded arm;

(j) said pair of spring-loaded arms being positioned above said control rod and in a plane perpendicular to the plane of motion of said control rod; and (k) said spring-loaded arms being urged to meet at a point until urged apart by the upward motion of said control rod into said second inoperable position, such that said spring-loaded arms are urged to close behind said control rod when said control rod has reached said second inoperable position, and said control rod will be retained in said second inoperable position until said spring-loaded arms are manually urged apart;

whereby an imminent overflow in said toilet may be detected and averted by retaining the control rod in said second inoperable position and thereby forcing said fill valve into an off position regardless of water level.

3. A toilet overflow prevention device comprising:

(a) an electromechanical actuation device;

(b) said electromechanical actuation device being movable in the vertical dimension in response to an electronic signal;

(c) said actuation device being rotatably fixed to a control rod associated with the fill valve of a conventional toilet filling system such that said control rod may be lifted up from a first normal operating position to a second inoperable position by the action of said actuation device;

(d) a sensor;

(e) an electronic link from said sensor to said electromechanical actuation device;

(f) a logic means for converting reading signals generated by said sensor into control signals directed to said electromechanical actuation device according to a heuristic;

(g) a latch mechanism;

(h) said latch mechanism being shaped and tensioned so as to receive said control rod in said second inoperable position and retain said control rod in said second inoperable position until manually released; and (i) said sensor further comprising a housing having a plurality of retaining hooks affixed thereto;

whereby an imminent overflow in said toilet may be detected and averted by retaining the control rod in said second inoperable position and thereby forcing said fill valve into an off position regardless of water level.

4. The toilet overflow prevention device of claim 3 wherein said sensor is located in the bowl of said toilet and retained in position by said plurality of retaining hooks being suspended from the edge of the bowl of said toilet.

5. The toilet overflow prevention device of claim 4 wherein said sensor measures the presence of water at its position, and wherein its position is above the safe water level of the bowl of said toilet.

6. The toilet overflow prevention device of claim 5 wherein said heuristic comprises an inference that the presence of water at the location of said sensor indicates the presence of an imminent overflow condition in said toilet.

7. A toilet overflow prevention device comprising:

(a) an electromechanical actuation device;

(b) said electromechanical actuation device being movable in the vertical dimension in response to an electronic signal;

(c) said actuation device being rotatably fixed to a control rod associated with the fill valve of a conventional toilet filling system such that said control rod may be lifted up from a first normal operating position to a second inoperable position by the action of said actuation device;

(d) a sensor;

(e) an electronic link from said sensor to said electromechanical actuation device;

(f) a logic means for converting reading signals generated by said sensor into control signals directed to said electromechanical actuation device according to a heuristic;

(g) a latch mechanism;

(h) said latch mechanism being shaped and tensioned so as to receive said control rod in said second inoperable position and retain said control rod in said second inoperable position until manually released;

(i) said sensor measuring the presence of water at its position;

(j) said sensor's position being above the safe water level of the bowl of said toilet; and (k) said heuristic comprising an inference that the presence of water at the location of said sensor indicates the presence of an imminent overflow condition in said toilet;

whereby an imminent overflow in said toilet may be detected and averted by retaining the control rod in said second inoperable position and thereby forcing said fill valve into an off position regardless of water level.

8. The toilet overflow prevention device of claim 3 wherein said sensor is located in the tank of said toilet and retained in position by said plurality of retaining hooks being suspended from the edge of the tank of said toilet.

9. The toilet overflow prevention device of claim 8 wherein said sensor comprises an optical sensor and a chronometer, and wherein said optical sensor is configured to measure the presence of said control rod when said control rod is in a third elevated operable position above or within the range of said first operable position and below said second inoperable position, such that said third elevated operable position is associated with said fill valve being closed in the normal operation of said toilet, and wherein said chronometer is configured to measure the time said control rod is in said third elevated operable position.

10. The toilet overflow prevention device of claim 3 wherein said sensor is located in the tank of said toilet and retained in position by said plurality of hooks being suspended from the edge of the tank of said toilet.

11. The toilet overflow prevention device of claim 10 wherein said sensor comprises an optical sensor and a chronometer, and wherein said optical sensor is configured to measure the presence of said control rod when said control rod is in a third elevated operable position above or within the range of said first operable position and below said second inoperable position, such that said third elevated operable position is associated with said fill valve being closed in the normal operation of said toilet, and wherein said chronometer is configured to measure the time said control rod is in said third elevated operable position.

12. The toilet overflow prevention device of claim 9 wherein said heuristic comprises an inference that the presence of water at the location of said sensor indicates the presence of an imminent overflow condition in said toilet.

13. The toilet overflow prevention device of claim 11 wherein said heuristic comprises an inference that the presence of water at the location of said sensor indicates the presence of an imminent overflow condition in said toilet.

14. The toilet overflow prevention device of claim 6 wherein said electromechanical actuation device is a solenoid.

15. The toilet overflow prevention device of claim 12 wherein said electromechanical actuation device is a solenoid.

16. The toilet overflow prevention device of claim 3, wherein said electromechanical actuation device is a solenoid, and wherein said latch mechanism comprises a spring-loaded pin positioned horizontally so as to engage with a hole in the rod of said solenoid when said solenoid is in a raised position, and further positioned so as to be manually disengageable.

17. The toilet overflow prevention device of claim 3, wherein said latch mechanism comprises a pair of spring-loaded arms positioned above said control rod and in a plane perpendicular to the plane of motion of said control rod, said spring-loaded arms being urged to meet at a point until urged apart by the upward motion of said control rod into said second inoperable position, such that said spring-loaded arms are urged to close behind said control rod when said control rod has reached said second inoperable position, and said control rod will be retained in said second inoperable position until said spring-loaded arms are manually urged apart.

18. The toilet overflow prevention device of claim 7, wherein said electromechanical actuation device is a solenoid, and wherein said latch mechanism comprises a spring-loaded pin positioned horizontally so as to engage with a hole in the rod of said solenoid when said solenoid is in a raised position, and further positioned so as to be manually disengageable.

19. The toilet overflow prevention device of claim 7, wherein said latch mechanism comprises a pair of spring-loaded arms positioned above said control rod and in a plane perpendicular to the plane of motion of said control rod, said spring-loaded arms being urged to meet at a point until urged apart by the upward motion of said control rod into said second inoperable position, such that said spring-loaded arms are urged to close behind said control rod when said control rod has reached said second inoperable position, and said control rod will be retained in said second inoperable position until said spring-loaded arms are manually urged apart.

* * * * *